US008088018B2

(12) United States Patent
Melville et al.

(10) Patent No.: US 8,088,018 B2
(45) Date of Patent: Jan. 3, 2012

(54) GOLF AID

(75) Inventors: Ian Melville, Lincolnshire (GB); Paul Pepper, Rutland (GB); Gary Tremble, North Yorkshire (GB); Angus Milnes, North Yorkshire (GB)

(73) Assignee: Swingrite (UK) Limited, North Yorkshire (GB)

( * ) Notice: Subject to any disclaimer, the term of this patent is extended or adjusted under 35 U.S.C. 154(b) by 0 days.

(21) Appl. No.: 12/972,882

(22) Filed: Dec. 20, 2010

(65) Prior Publication Data

US 2011/0143850 A1 Jun. 16, 2011

Related U.S. Application Data

(63) Continuation of application No. PCT/GB2009/001291, filed on May 21, 2009.

(51) Int. Cl.
*A63B 69/36* (2006.01)

(52) U.S. Cl. ..... 473/227; 473/276

(58) Field of Classification Search ..... 473/207, 473/212, 219, 226, 227, 229, 257, 266, 267, 473/276, 422

See application file for complete search history.

(56) References Cited

U.S. PATENT DOCUMENTS

| | | | | |
|---|---|---|---|---|
| 3,595,583 | A | 7/1971 | Oppenheimer | |
| 4,318,546 | A | 3/1982 | Chen | |
| 4,334,684 | A | 6/1982 | Sterling | |
| 4,758,000 | A | 7/1988 | Cox | |
| 5,050,868 | A * | 9/1991 | Pearson | 482/94 |
| 5,156,401 | A * | 10/1992 | Hodgkiss | 473/227 |
| 5,332,211 | A * | 7/1994 | Rife et al. | 473/258 |
| 5,348,304 | A * | 9/1994 | Meade | 473/409 |
| 5,634,858 | A | 6/1997 | Bellagamba | |
| 5,738,617 | A | 4/1998 | Watson | |
| 6,013,013 | A | 1/2000 | Wolf | |
| 6,174,270 | B1 | 1/2001 | Dagenais | |
| 6,554,718 | B2 | 4/2003 | Back | |
| 6,595,865 | B2 * | 7/2003 | Stitz | 473/257 |
| 6,623,409 | B1 * | 9/2003 | Abelbeck | 482/104 |
| 6,656,055 | B1 | 12/2003 | Marro | |
| 7,033,284 | B2 | 4/2006 | Yoshimura | |
| 7,121,987 | B2 | 10/2006 | Sharps | |
| 7,150,683 | B2 * | 12/2006 | Bender | 473/266 |
| 7,641,596 | B2 | 1/2010 | Sharps | |
| 7,708,650 | B2 | 5/2010 | Lloyd | |
| 2007/0072694 | A1 | 3/2007 | Meneghini | |

FOREIGN PATENT DOCUMENTS

| | | |
|---|---|---|
| GB | 2416997 A | 2/2006 |
| WO | 0115785 A2 | 3/2001 |

OTHER PUBLICATIONS

International Search Report and Written Opinion for PCT/GB2009/001291; Sep. 21, 2009; 13 pgs.
Search Report for GB0811420.9; Oct. 6, 2008; 1 pg.
Search Report for GB0821142.7; Feb. 26, 2009; 2 pgs.

* cited by examiner

*Primary Examiner* — Nini Legesse
(74) *Attorney, Agent, or Firm* — Gardner Groff Greenwald & Villanueva, PC

(57) ABSTRACT

The invention relates to a golf training aid comprising a frame, having retaining means, and a bar retained by the retaining means so that in use the bar can move only in a fixed plane. The bar is arranged to be coupled to a user in such a way that in use the user's shoulders are constrained to move in or parallel to the fixed plane. This allows a user to correctly learn a pendulum putting stroke.

17 Claims, 5 Drawing Sheets

GOLF AID

CROSS-REFERENCE TO RELATED APPLICATIONS

This application is a continuation of International PCT Patent Application No. PCT/GB2009/001291 filed May 21, 2009, which claims the benefit of United Kingdom Application GB 0811420.9 filed on Jun. 20, 2008 and United Kingdom Application GB 0821142.7 filed on Nov. 19, 2008, which are incorporated herein by reference in their entireties for all purposes.

BACKGROUND

The present invention relates to a golf training aid, in particular, though not exclusively, to a putting training aid for the pendulum putting stroke.

The game of golf is a popular game played by both professionals and amateurs. Players aim to hit a golf ball from a tee to a hole in as few strokes as possible. The hole is located on a putting green which is a carefully prepared carpet of short grass that surrounds the hole and provides a smooth surface on which the golf ball can roll. There are a number of types of shot that a player may make during a game. Three of the most common strokes are a drive, an approach shot and a putt. A drive is a long-distance shot that is played from the tee, the aim being to hit the ball as far as possible towards the green. An approach shot is made with the aim of landing the ball on the green. A putt is usually made on the putting green, the intention being to roll the ball along the green into the hole.

It is often believed that good putting is the key to obtaining a low score. In order to putt accurately and consistently it is important to have a reliable and reproducible putting action. There are a number of different putting actions that are commonly used by different players. These include the pop stroke, the hook stroke, the cut stroke, the wrist stroke, the block stroke, the push stroke and the pendulum stroke. The pendulum stroke is often considered to be the easiest, simplest, most reproducible and therefore the most reliable way to putt.

Figures 1A, 1B, 1C:
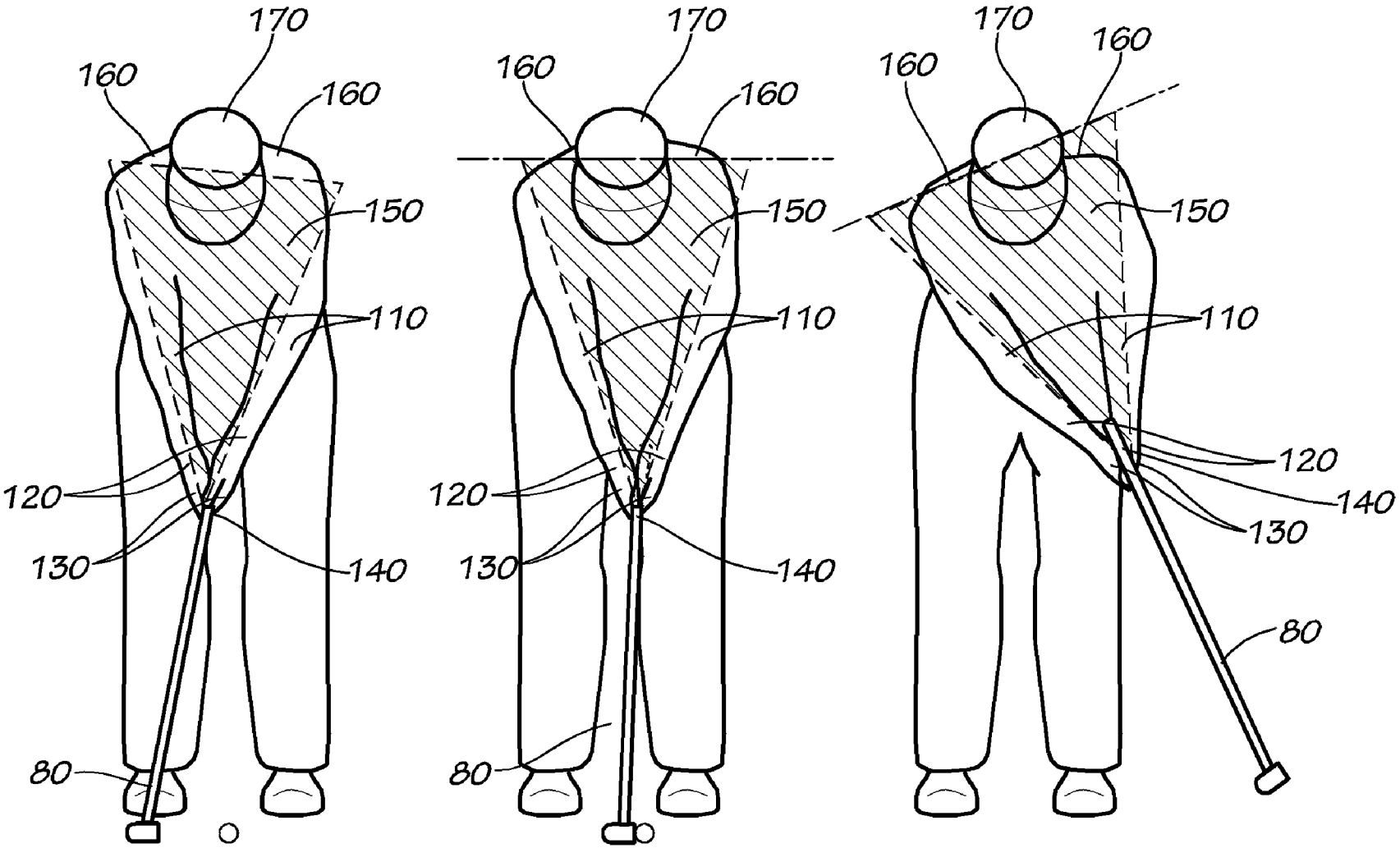

With reference to FIG. 1, the pendulum action involves keeping the positional relationship between the arms 110, wrists 120, hands 130 and putter 80 constant, thus forming a 'Y' shape 140. In order to hit the ball, the player's shoulders 160 are rotated (or rocked) in a single plane with the player's head 170 being the 'pivot' point. During the whole stroke, from backswing (A), to impact (B), to follow-through (C), the 'Y' shape 140 is kept constant and the player's shoulders 160 are maintained in a single plane. It is also desirable for the player to keep his head 170 over the starting position of the ball during the stroke. A pendulum putting action helps to provide accurate putts because there are as few body movements as possible.

A specific type of pendulum putting action is known as the vertical pendulum stroke. In this action, the player's shoulders 160 are maintained in a vertical plane during the stroke. This means that the putter head travels in a straight line parallel to the plane of the player's shoulders during the stroke. Since the player should be aligned in the direction they wish the ball to travel (known as the aim direction), the vertical pendulum stroke ensures that the ball travels in the aim direction irrespective of the position in the stroke at which impact occurs. This therefore further improves the reliability of the pendulum putting action. In some putting actions the triangle 150 formed by the player's arms 110 and shoulders 160 is maintained in the same plane as that of the shoulders 150.

Many players find it difficult to consistently reproduce a pendulum putting action. This is partly because in many other golf strokes the wrists flex and the shoulders rotate out of plane. This means that the pendulum putting stroke may feel somewhat unnatural.

In order to help players improve their pendulum putting action a number of training aids have been designed. One training aid comprises a straight track within which the putter head travels. Whilst this ensures that the putter head travels in a straight line, it does not prevent the player from flexing his wrists, rotating his shoulders or moving his head. In other words, it teaches the result of a vertical pendulum putting action as opposed to the body movement required to ensure a vertical pendulum putting action. Therefore, when the track is taken away, the player may find that it is still difficult to move the putter head in a straight line and produce accurate putts.

It is therefore desirable to provide a putting training aid that aims to teach a player the feel and body movement of a consistent pendulum putting action.

SUMMARY

According to the present invention there is provided a golf training aid comprising: a frame having retaining means; and a bar retained by the retaining means so that in use the bar can move only in a fixed plane; wherein the bar is arranged to be coupled to a user in such a way that in use the user's shoulders are constrained to move in or parallel to the fixed plane. The bar is arranged to be attached to, held on, or held by a user, for example, so that the bar moves with the user's shoulders. This helps a user to rotate their shoulders only within a plane that is parallel to, or coincident with, the fixed plane within which the bar is constrained to move.

It is preferable that the bar is arranged to be located under, and held by, a user's arms during use. This provides an easy way of coupling the bar to the user.

In one embodiment the retaining means retains the bar in a vertical plane. This helps the user to learn the vertical pendulum stroke which is particularly preferable for some players. The retaining means may be adjustable so that the inclination of the fixed plane can be altered to enable different styles of strokes to be practised by the user.

Movement of the bar along its length (otherwise known as lateral movement) may be at least partially restricted. This means that when the bar is coupled to the user, the user is at least partially restricted from moving from side to side.

The retaining means may comprise two parallel slots, each slot having one end of the bar located within it. This provides a simple way of retaining a bar in a fixed plane whilst allowing it to rotate and move up and down. If the bar is to be retained in a substantially vertical plane then the slots may be substantially vertical. Each slot may be defined by a pair of parallel members having a gap between them.

The bar may have at least one stop that is larger than its corresponding slot such that movement of the bar along its length is at least partially restricted.

The frame may comprise a base frame portion that is arranged to sit on the ground and an upper frame portion. The user may then stand within the upper frame portion when using the training aid. The retaining means may be mounted to the upper frame portion. A mirror may be mounted on the base frame portion. In use a user can focus on their reflection in the mirror. This helps to prevent them from moving their head.

In one embodiment the golf training aid may comprise a club attachment device for attaching the shaft of a golf club to the bar. This helps a user to maintain a fixed relationship between their shoulders, arms, wrists and club. It may be desirable to attach the club substantially perpendicularly to the bar.

The club attachment device may comprise a first portion, a second portion and a lockable pivot, the first portion being pivotally connected to the second portion by the lockable pivot so that the first and second portion can be moved relative to one another and fixed relative to one another, the first portion being attached to the bar and the second portion having an attachment part for attaching to the shaft of a golf club. The length of the first portion may be varied by the user. Further, the first portion may comprise an inner part, an outer part and a fixing part, the fixing part being used to secure the inner part to the outer part. These features allow a club to be attached to the bar at a position that is comfortable for the user. It also allows the position of the club to be easily varied for different users.

The attachment part may comprise a first receiving part arranged to receive a first portion of the shaft of a golf club. The attachment part may further comprise a second receiving part arranged to receive a second portion of the shaft of a golf club. This allows a club to be easily and securely attached to the bar.

The bar may comprise two end portions and a chest portion, the end portions being in axial alignment and the chest portion defining a recess such that in use the recess is arranged to accommodate a user's chest and each end portion is arranged to be located under each arm of a user respectively. The chest portion may comprise an axial portion that is parallel to the end portions, the axis of the axial portion being offset from the axis of the end portions. This allows the bar to be easily and comfortably held by (otherwise known as coupled to) a user.

The invention may comprise any combination of the features and/or limitations referred to herein, except combinations of such features as are mutually exclusive.

DETAILED DESCRIPTION

Figure 2:
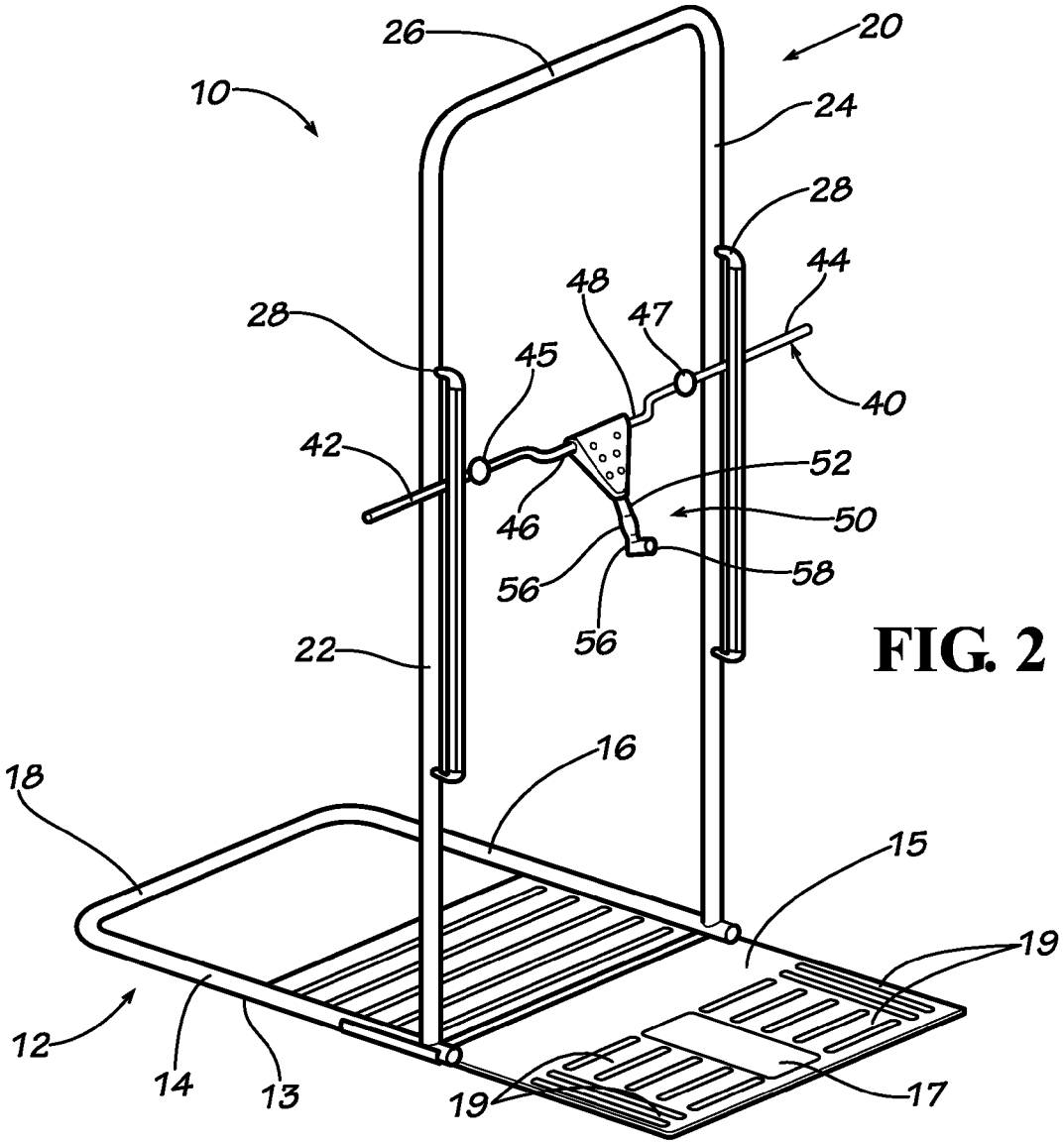
Figure 4:
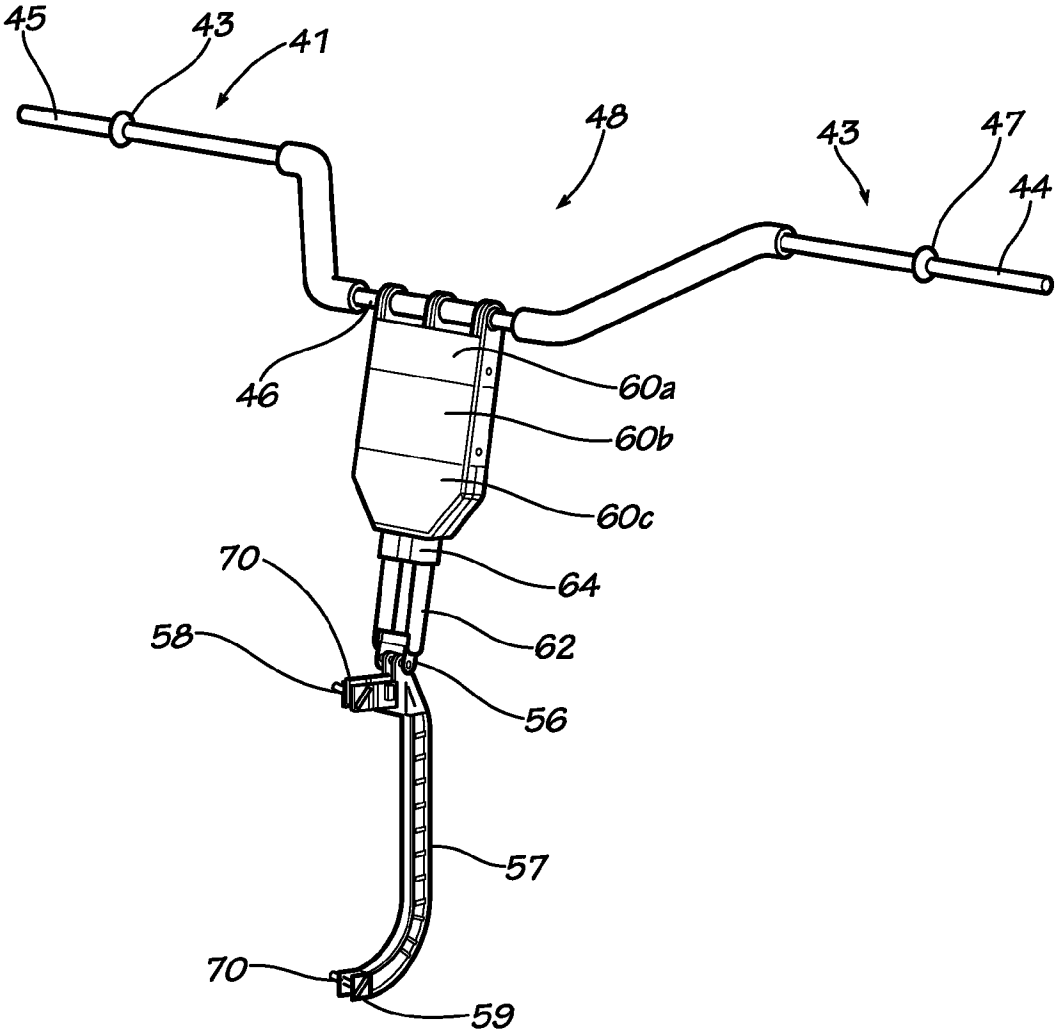
Figure 3:
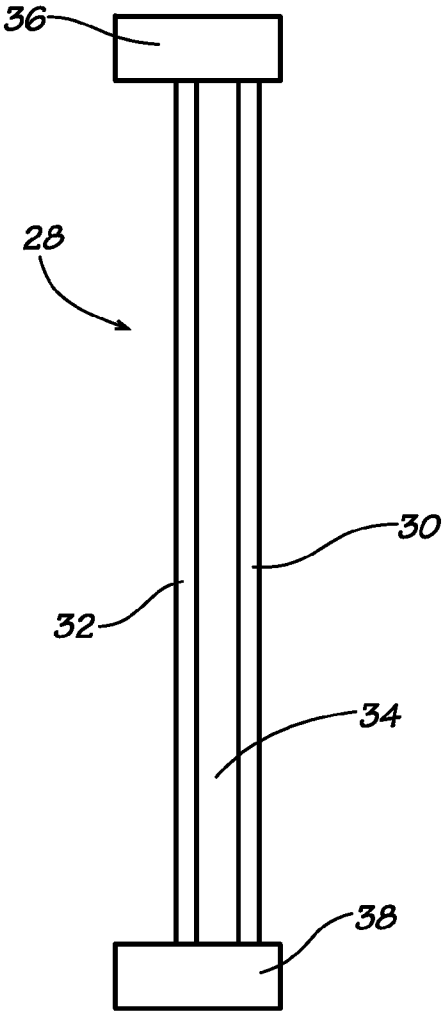
Figure 5:
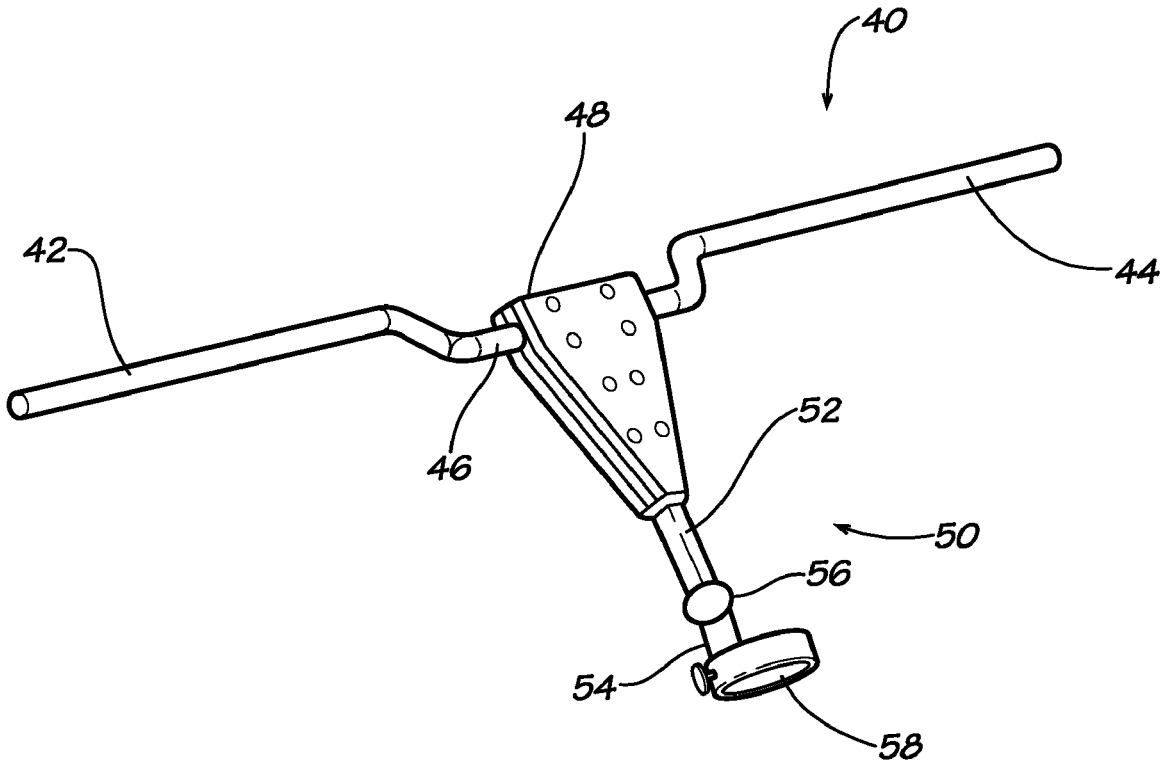
Figure 5A:
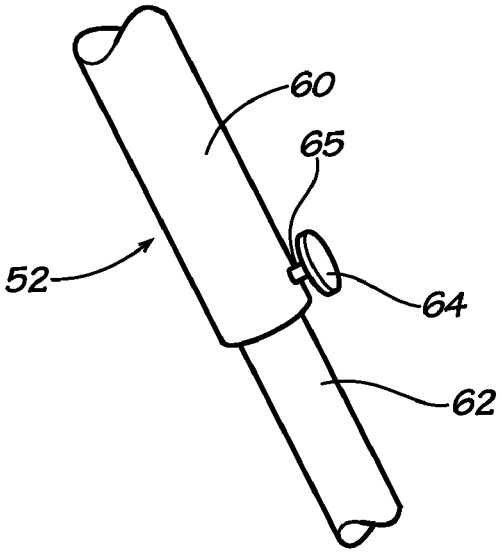
Figure 5B:
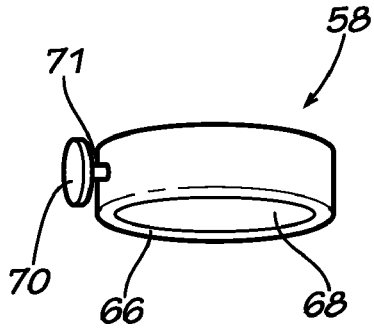
Figure 7:
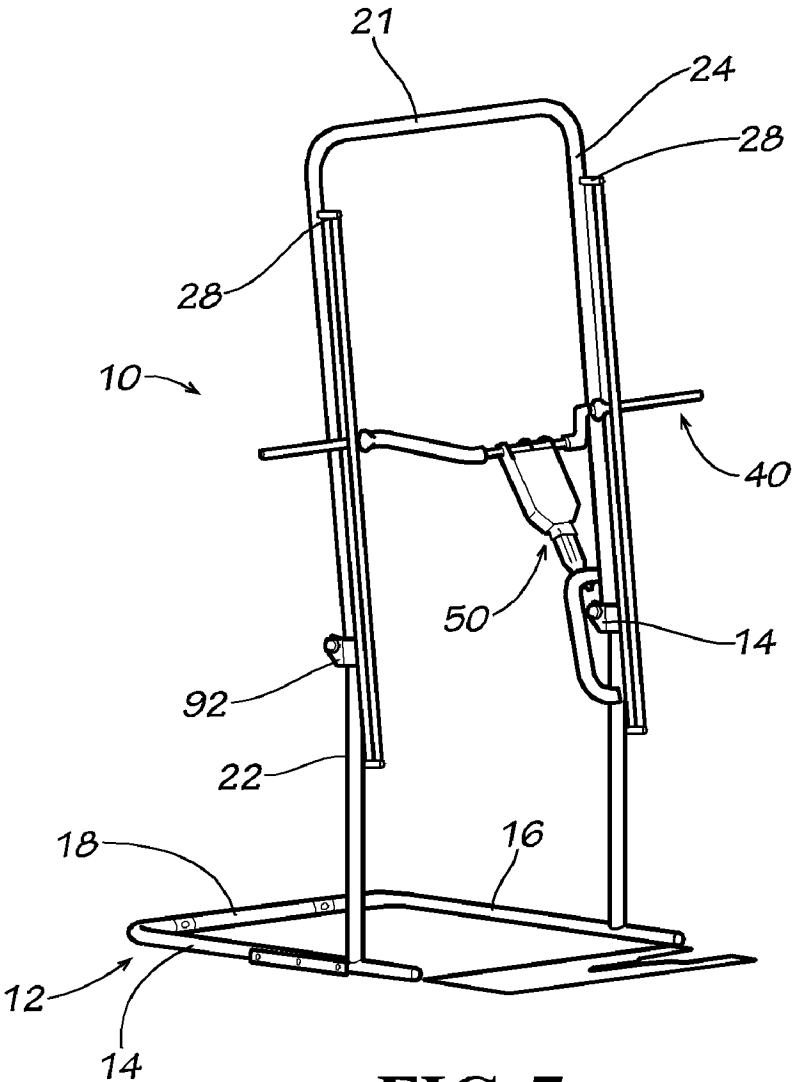
Figure 6:
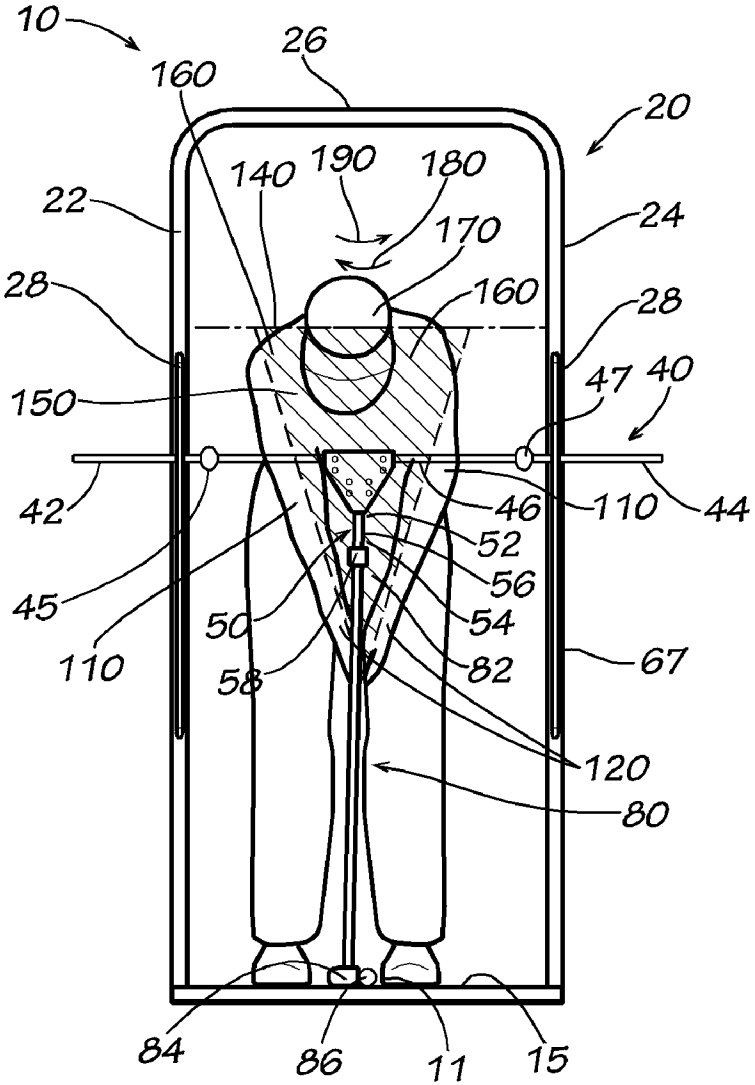

Embodiments of the present invention will now be described, by way of example, with reference to the accompanying drawings, in which:

FIG. 1 schematically shows a typical pendulum putting stroke;

FIG. 2 schematically illustrates a golf training aid according to an embodiment of the invention;

FIG. 3 schematically illustrates a retaining means;

FIG. 4 schematically illustrates a first embodiment of a bar and club attachment device;

FIG. 5 schematically illustrates a second embodiment of a bar and club attachment device;

FIG. 6 schematically illustrates a golf training aid according to an embodiment of the invention in use; and FIG. 7 schematically illustrates a golf training aid according to a further embodiment of the invention.

A mode of use of the golf training aid 1 will now be described with reference to FIG. 2 and FIG. 6. The golf training aid 1 comprises a frame 10, a bar 40 having a recess 48, means for retaining the bar in a vertical plane 28 and a club attachment device 50 that is attached to the bar. A user locates an end portion of the shaft/grip 82 of his golf putter 80 in the club attachment device 50. The user then adopts a putting stance within the frame 10 of the golf training aid 1 and locates their chest in the recess 48 of the bar 40. The bar 40 should be in contact with the user's chest. The user then puts each arm 110 over the bar 40 and rests the bar 40 under their armpits. The user then grips the shaft 82 of the putter 80 in the usual way. If the putter 80 is not in the correct position, for example if the putter is inclined at the incorrect angle or if the head of the putter is too far away from the floor, then this may be altered by the club attachment device 50 which is discussed in detail below. The user then locates their head over a mirror 17 so that they can see the reflection of their eyes. In this position the bar 40 is held under the user's armpits and across their chest and the club is held in the usual way.

Using the training aid a golf ball 11 may be struck using a perfect vertical pendulum putting stroke. This is done by the user rotating his shoulders first in one direction 180, for a backswing, and then in the opposite direction 190, for the stroke and follow-through. The user can focus on the reflection of his eyes in the mirror 17 in order to ensure that his head 170 stays still.

The golf training aid ensures that a 'Y' shape 140 is formed by the user's arms 110 and putter 80. It is not possible for the user to flex or roll (rotate) his wrists 120 and the angle of the putter shaft 82 relative to the bar cannot be changed. Further, the putter 80 cannot be brought closer to the body or moved further away from the body. This ensures that the 'Y' shape 140 is maintained throughout the stroke.

Also, since the bar 40 is retained in a fixed vertical plane by the retaining means 28, it is only possible for the bar 40 to move in this fixed vertical plane. When the user rotates his shoulders clockwise 180 then the bar 40 rotates clockwise (as seen from the front) within the retaining means 28 in the fixed vertical plane. More specifically, as the bar 40 rotates clockwise one end portion 42 goes up within the retaining means 28 and the other end portion 44 goes down within the retaining means 28. When the user rotates his shoulders anti-clockwise 190 then the bar 40 rotates anti-clockwise within the retaining means 28 in the fixed vertical plane. Since the bar 40 is located under the user's arms 110 and against his chest, the user's shoulders are prevented from rotating out of a fixed vertical plane. This means that the user's shoulders 160 are kept in a fixed vertical plane throughout the stroke.

As discussed previously, if during a pendulum putting stroke the 'Y' shape 140 can be maintained and the user's shoulders 160 can be kept in a fixed vertical plane then the putter head 84 moves in a straight line that is parallel to the fixed vertical plane. The golf training aid 1 as described herein ensures that both of these criteria are met.

A specific embodiment of the golf training aid will now be described in detail. As shown in FIG. 2, the golf training aid 1 comprises a frame 10 of tubular steel having a base frame portion 12 and an upper frame portion 20. The base frame portion 12 comprises three members 14, 16, 18. The upper frame portion 20 comprises three members 22, 24, 26, namely two uprights and a horizontal that define an arch. The base frame portion 12 and the upper frame portion 20 are attached together so that the plane defined by the upper frame portion 20 is substantially perpendicular to a plane defined by the base frame portion 12.

Each vertical member 22, 24 of the upper frame portion 20 has a retaining means 28 attached to it. With reference to FIG. 3, each retaining means 28 comprises two parallel members 30, 32 that are spaced apart so as to define a gap 34, or slot, of a constant width. The parallel members 30, 32 are connected together at the top and bottom by end stops 36, 38. The parallel members 30, 32 may be tubular steel of circular cross-section and may be coated with a friction-reducing coating such as nylon. Alternatively, the parallel members 30, 32 may be formed from a rigid plastic. Instead of a circular cross-section, the parallel members 30, 32 may have a square or rectangular cross-section. The gap 34, or slot, formed between the parallel members 30, 32 should have a width that is substantially constant and slightly greater than the thickness of the bar 40. In this embodiment the end stops 36, 38 are moulded from plastic, each end stop having two holes, each hole for accepting one end of one of the parallel members 30, 32. Thus the retaining means 28 can be assembled by pushing together the end stops 36, 38 and the parallel members 30, 32.

Referring back to FIG. 2, a retaining means 28, as described above, is attached to each of the vertical members 22, 24 of the upper frame portion 20 at substantially the same height and in an orientation such that the slots 34 of the retaining means 38 are parallel and face each other. In this embodiment, each retaining means 28 is attached to the upper frame portion 20 by two screws (not shown) that pass through the back of the vertical member 22, 24 and into threaded holes provided in each end stop 36, 38. There are a number of different heights at which the retaining means 28 may be attached to the upper frame portion 20.

The base frame portion 12 also comprises a thin steel rectangular plate 13 that is welded in between the horizontal members 14, 16 and extends beyond the horizontal members. This provides the frame with additional structural stability. On top of this steel plate 13 there is provided a mat 15 that may be green felt, for example, that visually simulates a golf putting green. In one embodiment the mat 15 has a non-slip surface. The mat 15 may be releasably attached to the base frame portion 12 using hooks, Velcro®, hook-and-eye tape or poppers, for example. The mat 15 is optional and the golf training aid 1 may be used without it. A portion of the mat 15 protrudes from the base frame portion 12 and in the middle of this portion a mirror 17 is provided. A number of sets of parallel lines 19 are also provided in this area. The function of these elements will be discussed later.

With reference to FIG. 4, the golf training aid 1 also comprises a bar 40, formed in two parts 41, 43 that are held together by a club attachment device 50 to which a golf putter can be secured.

The bar 40 comprises a first part 41 having a first end portion 42 and a second part 43 having a second end portion 44. When the two parts 41, 43 are connected together a chest portion 46 is defined. Each part 41, 43 is manufactured by bending tubular steel. The end portions 42, 44 of the bar 40 have a thickness that is slightly smaller than the width of the gap 34 provided in the retaining means 28. The axes of the first end portion 42, second end portion 44 and chest portion 46 are parallel. The first end portion 42 and second end portion 44 are in axial alignment and the axis of the chest portion 46 is offset from the axes of the first and second end portions 42, 44 so as to define a recess 48. In other embodiments the bar 40 may be entirely straight or the recess 48 may be of a semi-circular shape. Whilst the bar 40 has been described as being manufactured from a single piece of tubular steel, other suitable materials may be used.

The club attachment device 50 comprises a first portion 52, a second portion 54 and, a lockable pivot 56. The first portion 52 is pivotally attached to the second portion 54 by the lockable pivot 56, the axis of the pivot 56 being perpendicular to the axes of the first and second portion 52, 54. This arrangement allows the angle between the first portion 52 and the second portion 54 to be adjusted and secured.

The first portion 52 comprises three blocks 60*a*, 60*b*, 60*c* that are detachably attached together, an inner sliding part 62 and a fixing part 64. The middle block 60*b* may be removed in order to alter the length of the first part 52. Further, the inner sliding part 62 can be moved relative to the lower block 60*c* to alter the length of the first part 52. In this embodiment the sliding part 62 is attached to the pivot 56. The fixing part 64, which may be a quick-release bolt, is used to lock the sliding part 62 to the lower block 60*c* in order to prevent relative movement between the two.

The second portion 54 comprises a first upper attachment portion 58, a brace 57, and a second lower attachment portion 59. The first and second attachment portions 58, 59 are similar in design and are connected together by the brace 57. Each attachment portion comprises an opening that is arranged to receive a portion of a golf club shaft (or grip). Each can grip the portion of the shaft by reducing the size of the opening using a fixing part 70 such as a quick-release bolt.

The first attachment portion 58 is for holding an upper end portion of a golf club shaft and the second attachment portion 59 is for holding a lower portion of a golf club shaft. In use a user's hands are located in between the first and second attachment portions 58, 59. The brace 57 does not interfere with the user's grip as it is U-shaped away from the shaft. The two attachment parts 58, 59 and the brace 57 reduce the ease with which a golf club can be rotated within the club attachment device 50 when it is attached to it. As will be readily apparent to one skilled in the art, there are many other means of attaching a putter to the club attachment device 50.

The bar 40 is attached to the upper block 60*a* of the club attachment device 50. An end of each of the first and second bar parts 41, 43 is secured in an opening in the upper block 60*c*. In this embodiment the first portion 52 of the club attachment device 50 is attached at right angles to the mid-point of the chest portion 46 of the bar 40. Alternatively, the club attachment device may be offset with respect to the mid-point of the bar 40. The axis of the pivot 56 is arranged to be parallel to the axis of the chest portion 46*a* of the bar 40.

When in use, the club attachment device allows the angle of inclination of the putter to be altered and also enables the distance between the bar 40 and the putter head 84 to be altered so that the putter head is in close proximity to the floor or mat 15.

It should be noted that this is not essential that the club attachment device is in two pivotable portions, or that the length of the club attachment device may be varied.

FIG. 5 shows a second embodiment of the bar 40 and club attachment device 50 in which the bar is a single piece.

The club attachment device 50 comprises a first portion 52, a second portion 54 and a lockable pivot 56. The first portion 52 comprises an outer part 60, an inner part 62 and a fixing part 64. The outer part 60 and the inner part 62 can be moved relative to one another in order to alter the overall length of the first part 52. In this embodiment the inner part 62 is attached to the pivot 56. However, the outer part 60 may be attached to the pivot 56. The fixing part 64 is used to lock the inner part 62 to the outer part 60 in order to prevent relative movement between the two. The fixing part 64 may be a screw, that can be threaded through a hole 65 in the outer part, that can be tightened so as to abut against the outer surface of the inner part 62. However, there are other fixings that may be used to secure the outer part to the inner part.

An attachment portion 58 is attached to the end of the second portion 54 that is not attached to the pivot 56. In this embodiment the attachment portion 58 is in the form of a cup 66 having a receiving part 68 in the form of a recess within which the end of the shaft of a putter can be located. The attachment portion comprises a fixing part 70 for fixing the end of the shaft within the recess 68. This fixing part 70 may be a screw that can be threaded through a hole 71 in the cup 66 and tightened so as to abut against the outer surface of the shaft (or grip) of the putter.

The bar 40 and club attachment device 50 unit (as shown in FIG. 4 and FIG. 5) is attached to the upper frame part by locating each end portion 42, 44 of the bar 40 in a respective slot 34 of the retaining means 28. This means that the bar 40 can only move in a vertical plane.

The bar 40 is provided with two stops 45, 47 that are larger than the width of the slots 34. These restrict the lateral movement of the bar 40 within the retaining means 28 but allow the bar 40 to rotate freely in the plane of the slots 34.

Using the golf training aid 1, as described above with reference to FIG. 6, the putter head 84 should move in a straight line and the face 86 of the putter should be perpendicular to the direction of travel throughout the stroke. The plurality of sets of lines 19 described above help the user to ensure visually that this is the case. In particular, a first set ensures that the face 86 of the putter is perpendicular to the direction of travel and a second set ensures that the putter head 84 travels in a straight line. The stops 45, 47 located on the bar 40 restrict the lateral movement of the bar 40 and hence prevent the user from shifting from side-to-side.

The golf training aid essentially teaches the user the body movement of the vertical pendulum putting stroke. When the golf training aid is taken away and the user attempts to putt using a vertical pendulum putting stroke, it is much easier for him to reproduce it. This is because the user's body has learnt the movement and feel of the vertical pendulum putting stroke.

If the user has a particular problem with a certain element of the stroke, for example, they are able to maintain the 'Y' shape 140 but are unable to keep their shoulders 160 in a vertical plane, then the club attachment device 50 can be disconnected from the bar, or the putter 80 can be disconnected from the attachment portion 58. In this arrangement the bar 40 is still retained in a vertical plane and hence this teaches the feeling of rotating the shoulders in a vertical plane only.

In one embodiment the club may be detached from the club attachment device 50. This allows the user to practice a type of shot known as a chip in which the user's shoulders 160 are maintained in a vertical plane but their writs are allowed to flex.

If the user is unable to maintain the 'Y' shape 140 but can keep their shoulders 160 in a vertical plane then the bar 40 and club attachment device 50 unit can be taken out of the retaining means 28 and may be used on its own. In this arrangement it is not possible for the user to flex their wrists and the angle of the putter shaft 82 cannot be changed. Further, the putter 80 cannot be brought closer to the body or moved further away from the body. This ensures that the 'Y' shape 140 is maintained.

As will be readily apparent to one skilled in the art, other suitable means for retaining the bar 40 in a plane may be used. For example, the bar 40 may be fixed in a circumferential grove located in a vertical plane.

Although the golf training aid has been described as having retaining means 28 for retaining the bar 40 in a vertical plane, it may be desirable to retain the bar in a plane inclined to the vertical. This may be done, for example, by altering the angle between the upper frame portion 20 and the base frame portion 12. If the retaining means 28 retains the bar 40 in a non-vertical plane then the training aid will not teach the user the vertical pendulum putting stroke. Instead, it will teach the user an inclined pendulum putting stroke in which the putter head 84 will not travel in a straight line. Whilst this stroke is not as simple and reliable as the vertical pendulum, it may be preferred by some players.

It may also be desirable for the golf training aid 1 to be capable of retaining the bar 40 in one of a plurality of different planes. This may be useful if the training aid is to be used by different users, some of whom prefer the vertical pendulum stroke and others of whom prefer an inclined pendulum stroke of a particular angle. This may be done by providing means for altering and then fixing the inclination of the plane (with respect to the ground) in which the retaining means 28 retains the bar 40.

FIG. 7 shows one way of altering and fixing the plane in which the retaining means 28 retains the bar 40. The two uprights 22, 24 of the upper frame portion 20 are provided with lockable hinges 92, 94 at approximately the mid-point of their length. This allows part of the upper frame portion 20, with the retaining means 28 attached, to be inclined relative to the base frame portion 12 and then fixed. This means that the bar 40 is retained in an inclined plane and when the training aid is in use the shoulders 160 of the user are constrained to move in the chosen inclined and fixed plane. As will be readily apparent to one skilled in the art, there are a number of other ways of altering and fixing the angle of the plane in which the retaining means 28 retains the bar.

In the above described embodiments the members of the frame 10 are tubular steel, but other suitable materials or cross-sections may be used. Further, it is not essential that the members that comprise the base frame portion 12 and the upper frame 20 are parallel (or perpendicular where applicable) to each other.

The golf training aid 1 is designed to be supplied in flat-pack form. In particular, the upper frame portion 20 and base frame portion 12 may comprise a number of tubes that can be easily assembled. Alternatively, portions of the training aid 1 may come preassembled.

The invention claimed is:

1. A golf training aid comprising:

a frame having retaining means comprising first and second parallel slots; and a bar having a first end located in the first slot and a second end located in the second slot such that it is retained by the retaining means so that in use the bar can move and rotate only in a fixed plane which is defined by the two parallel slots;

wherein the bar is arranged to be coupled to a user by locating the bar under the user's arms such that in use the user's shoulders are constrained to move in or parallel to the fixed plane.

2. A golf training aid according to claim 1, wherein the retaining means retains the bar in a vertical plane.

3. A golf training aid according to claim 1, wherein the retaining means is adjustable so that the inclination of the fixed plane can be altered to enable different styles or strokes to be practised by the user.

4. A golf training aid according to claim 1, wherein movement of the bar along its length is at least partially restricted.

5. A golf training aid according to claim 1, wherein each slot is defined by a pair of parallel members having a gap between them.

6. A golf training aid according to claim 1, wherein the retaining means comprises two parallel slots, each slot having one end of the bar located within it, and wherein one end of the bar has at least one stop that is larger than its corresponding slot so as to at least partially restrict movement of the bar along its length.

7. A golf training aid according to claim 1, wherein the frame has a base frame portion that is arranged to sit on the ground and an upper frame portion.

8. A golf training aid according to claim 7, wherein the retaining means is mounted to the upper frame portion.

9. A golf training aid according to claim 7, further comprising a mirror mounted on the base frame portion.

10. A golf training aid according to claim 1, further comprising a club attachment device for attaching the shaft of a golf club to the bar.

11. A golf training aid according to claim 10, wherein the club attachment device comprises a first portion, a second portion and a lockable pivot, the first portion being pivotally connected to the second portion by the lockable pivot so that the first and second portion can be moved relative to one another and fixed relative to one another, the first portion being attached to the bar and the second portion having an attachment part for attaching to the shaft of a golf club.

12. A golf training aid according to claim 11, wherein the length of the first portion can be varied by the user.

13. A golf training aid according to claim 12, wherein the first portion comprises an inner part, an outer part and a fixing part, the fixing part being used to secure the inner part to the outer part.

14. A golf training aid according to claim 10, wherein the attachment part comprises a first receiving part arranged to receive a first portion of the shaft of a golf club.

15. A golf training aid according to claim 14, wherein the attachment part comprises a second receiving part arranged to receive a second portion of the shaft of a golf club.

16. A golf training aid according to claim 1, wherein the bar comprises two end portions and a chest portion, the end portions being in axial alignment and the chest portion defining a recess such that in use the recess is arranged to accommodate a user's chest and each end portion is arranged to be located under each arm of a user respectively.

17. A golf training aid according to claim 16, wherein the chest portion comprises an axial portion that is parallel to the end portions, the axis of the axial portion being offset from the axis of the end portions.

* * * * *